US006169367B1

(12) United States Patent
Muto et al.

(10) Patent No.: US 6,169,367 B1
(45) Date of Patent: Jan. 2, 2001

(54) DISCHARGE LAMP FOR AUTOMOBILE HAVING A CONVEX SURFACE IN THE DISCHARGE CHAMBER

(75) Inventors: Masaaki Muto, Kawasaki; Shinya Omori, Yokohama, both of (JP)

(73) Assignee: Stanley Electric Co., Ltd., Tokyo (JP)

( * ) Notice: Under 35 U.S.C. 154(b), the term of this patent shall be extended for 0 days.

(21) Appl. No.: 09/082,795

(22) Filed: May 21, 1998

(30) Foreign Application Priority Data

May 23, 1997 (JP) ..... 9-133796

(51) Int. Cl.[7] ..... H01J 61/30

(52) U.S. Cl. ..... 313/634; 313/570; 313/25; 313/573

(58) Field of Search ..... 313/634, 631, 313/637, 25, 17, 44, 570, 573, 493, 623, 624, 625, 635

(56) References Cited

U.S. PATENT DOCUMENTS 3,250,941 * 5/1966 Wilson et al. ..... 313/634
3,870,919 * 3/1975 Hellman et al. ..... 313/634
5,471,110 11/1995 Van Der Leeuw et al. ..... 313/25
5,528,104 * 6/1996 Kim et al. ..... 313/634
5,866,982 * 2/1999 Scott et al. ..... 313/634
5,923,127 * 7/1999 Keijser et al. ..... 313/634

FOREIGN PATENT DOCUMENTS 4-32497 5/1992 (JP) .

* cited by examiner

*Primary Examiner*—Nimeshkumar D. Patel
*Assistant Examiner*—Joseph Williams
(74) *Attorney, Agent, or Firm*—Morgan, Lewis & Bockius LLP

(57) ABSTRACT

A lamp bulb for a high pressure discharge lamp that includes a pair of opposing electrodes that projects a predetermined distance into a discharge chamber, molybdenum foils, lead wires, and a bulb, the lamp bulb includes a discharge chamber filled with a metal halide and a rare gas, the discharge chamber including at least a concave surface curving inwardly with respect to a Z-axis of the automotive high pressure discharge lamp, a discharge chamber portion surrounding the discharge chamber, including at least a convex surface curving outwardly along the Z-axis of the discharge lamp, tapered portions tapering towards the discharge chamber, sealed ends in which are located the molybdenum foils, the electrodes, and the lead wires, and sealed portions substantially free from substantial curvature change, the sealed portions being located between the discharge chamber and the sealed ends.

15 Claims, 2 Drawing Sheets

DISCHARGE LAMP FOR AUTOMOBILE HAVING A CONVEX SURFACE IN THE DISCHARGE CHAMBER

This invention claims the benefit of Japanese Patent Application No. 09-133796, filed on May 23, 1997, which is hereby incorporated by reference.

BACKGROUND OF INVENTION

1. Field of the Invention

The present invention relates to a high pressure discharge lamp and more particularly to a composition and a method of producing a high pressure discharge lamp for an automobile headlight or fog light.

2. Discussion of the Related Art

FIG. 4 illustrates a horizontal cross sectional view of a conventional automobile high pressure discharge lamp 40 used in an automobile headlight. The automotive high pressure discharge lamp 40 includes a bulb 41 including a center portion 41*a*, a discharge chamber 45 filled with a rare gas and a metal halide, and sealed portions 41*c* and sealed ends 41*b* are positioned around the center portion 41*a*. The sealed ends 41*b* each include molybdenum foils 43, lead wires 44, and a pair of electrodes 42 projecting a predetermined distance into the discharge chamber 45.

A conventional method of forming the discharge chamber includes providing a silica glass pipe (not shown) for forming the bulb 41, heating and softening the center portion 41*a*, blowing air into the silica glass pipe and expanding the center portion 41*a* until it obtains a substantially barrel-shaped form. In an actual application, an outer bulb and a socket are also added, although these steps are not illustrated herein.

FIG. 6 illustrates a conventional automobile headlight 60 including a high pressure discharge lamp 40, a reflector 61, a lens 62, and a shade 63.

FIG. 5 depicts a light distribution pattern $H_j$ of the conventional high pressure discharge lamp 40. An X-axis in FIGS. 5 and 6 correspond to the X-axis in FIG. 4. The X-axis passes through the center of an electrical arc A (shown in FIG. 4), formed between the electrodes 42, and crosses horizontal Z-axis of the automotive high pressure discharge lamp 40 at substantially a right angle. Light is emitted from the conventional automotive high pressure discharge lamp 40 symmetrically, i.e, forward and backward, through an angle range of approximately 45° with respect to the X-axis.

The conventional automotive high pressure discharge lamp 40 experiences several problems, the most severe of which is that the light distribution pattern Hj is inappropriate for use as an automobile headlight. As shown in FIG. 6, the reflector 61 of the automobile headlight 60 typically has a small longitudinal length and a small depth dimension. The light that is directed forward, through a large angle range of approximately 20°–45° with respect to the X-axis, is often glare light, since the light has not been reflected by the reflector 61 but passes directly through the lens 62. The function of shade 63 is to restrict the light directed forward of the X-axis at angles ranging between 20°–45°. The shade 63 substantially decreases efficiency of the automobile headlight 60 to such an extent that the emitted light from the high pressure discharge lamp 40 is approximately 25% of the total light emitted from the electrical arc A. As shown in FIG. 4, the difference of curvature between the bulb center portion 41*a* and the sealed ends 41*b* substantially changes at the sealed portions 41*c*. Therefore, when the automobile headlight 40 is turned on, spot-shaped glare light is emitted from the sealed portion 41*c* such that the automobile headlight 60 looks as if it has two or more light sources.

SUMMARY OF THE INVENTION

The present invention is directed to an automotive high pressure discharge lamp that substantially obviates one or more of the problems due to the limitations and disadvantages of the related art.

An object of the present invention is to provide a high pressure discharge lamp having an improved light distribution pattern.

Another object of the present invention is to provide a high pressure discharge lamp having increased efficiency.

A further object of the present invention is to provide a method of fabricating a high pressure discharge lamp with the above improved properties.

Additional features and advantages of the present invention will be set forth in the description which follows, and will be apparent from the description, or may be learned by practice of the invention. The objectives and other advantages of the invention will be realized and attained by the structure and process particularly pointed out in the written description as well as in the appended claims.

To achieve these and other advantages and in accordance with the purpose of the present invention, as embodied and broadly described, in accordance with a first aspect of the high pressure discharge lamp for an automobile there is provided a lamp bulb for an automotive high pressure discharge lamp includes a pair of opposing electrodes that projects a predetermined distance into a discharge chamber, molybdenum foils, lead wires, and a bulb, the lamp bulb including a discharge chamber filled with a metal halide and a rare gas, the discharge chamber including a concave surface curving inwardly with respect to a Z-axis of the automotive high pressure discharge lamp, a discharge chamber portion surrounding the discharge chamber, including a convex surface curving outwardly with respect to the Z-axis of the high pressure discharge lamp, tapered portions tapering towards the discharge chamber, sealed ends in which are located the molybdenum foils, the electrodes, and the lead wires, and sealed portions substantially free from substantial curvature change, the sealed portions being located between the discharge chamber and the sealed ends.

In accordance with a second aspect of the high pressure discharge lamp, a method for producing a high pressure discharge lamp includes a pair of opposing electrodes a portion of which is projected to a predetermined distance into a discharge chamber, molybdenum foils, lead wires, tapered portions, sealed ends, wherein the discharge chamber has a concave surface curving inwardly relative to a Z-axis of the high pressure discharge chamber, and a discharge chamber portion that has a convex surface curving outward relative to a horizontal axis of the high pressure discharge lamp, the method for producing the high pressure discharge lamp includes the steps of disposing an electrode, a molybdenum foil, and a lead wire within a silica glass pipe, sealing the electrode, the molybdenum foil, and the lead wire within the silica glass pipe, heating and melting the silica glass pipe about its center portion, disposing a curvature pattern adjacent to an outer surface of the silica glass pipe corresponding to the convex surface, rotating the silica glass pipe in contact with the pattern to form the convex surface, and applying a first pressure to the silica glass pipe externally maintaining the shape of the outer surface of the pipe such that the inner surface of the pipe at a softened center portion deforms inwardly along a Z-axis of the automotive high pressure discharge lamp to form the concave surface, while air is introduced into the silica glass pipe at a second pressure.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constituted a part of the specification, illustrate embodiments of the invention and together with the description serve to the principles of the invention.

DETAILED DESCRIPTION OF THE PREFERRED EMBODIMENTS

Reference will now be made in detail to the preferred embodiments of the present invention, examples of which are illustrated in the accompanying drawings.

Figure 1:
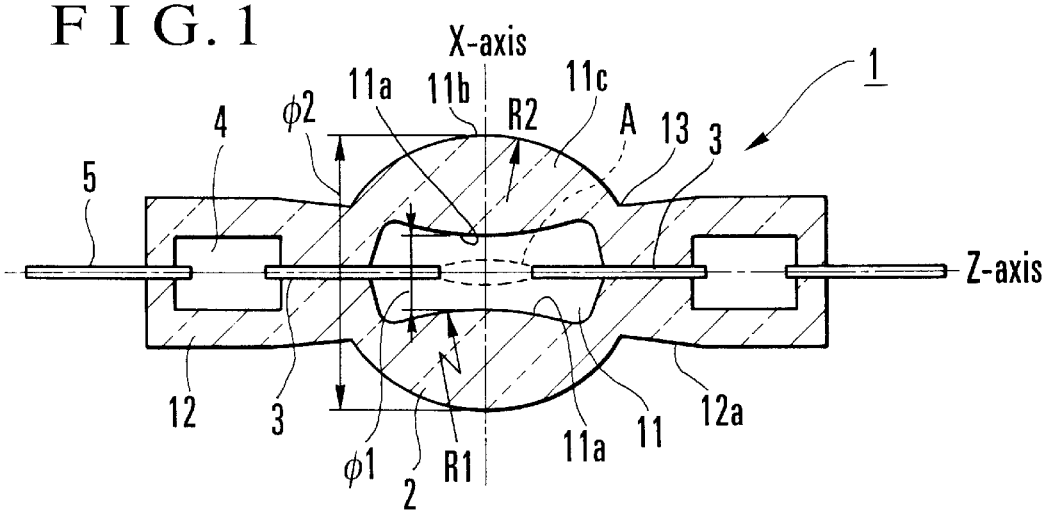
FIG. 1 is a cross-sectional view of a first preferred embodiment of the present invention.

FIG. 1 illustrates the automotive high pressure discharge lamp 1 according to a first embodiment of the present invention. The automotive high pressure discharge lamp 1 includes a discharge chamber 11 filled with a metal halide and a rare gas, a pair of opposing electrodes 3 projecting into the discharge chamber 11, molybdenum foils 4, lead wires 5, and a bulb 2. The bulb 2 includes a discharge chamber portion 11*c* surrounding the discharge chamber 11, tapered portions 12*a* tapering towards the discharge chamber 11, sealed ends 12, and sealed portions 13. The discharge chamber portion 11*c* is a combination of two convex lenses arranged as it the convex lenses contact each other at their flat surfaces. The discharge chamber 11 includes a concave surface 11*a* curving inwardly along a horizontal Z-axis of the automotive high pressure discharge lamp 1, and the discharge chamber portion 11*c* includes a convex surface 11*b* curving outwardly along the horizontal Z-axis of the automotive high pressure discharge lamp 1. The reader should note that the high pressure discharge lamp is symmetrically constructed along the x-axis and z-axis, and therefore reference numerals representing identical structures have been omitted for the most part.

Figure 2:
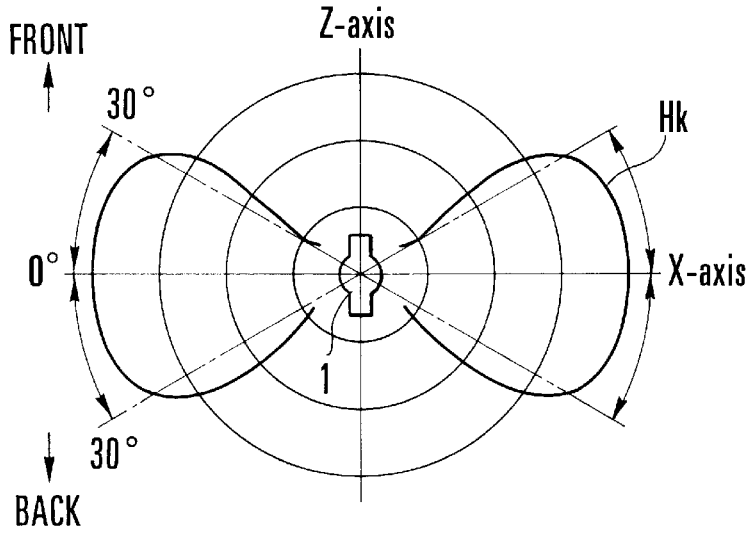
FIG. 2 illustrates a light distribution pattern of the first preferred embodiment of the present invention.
Figure 5:
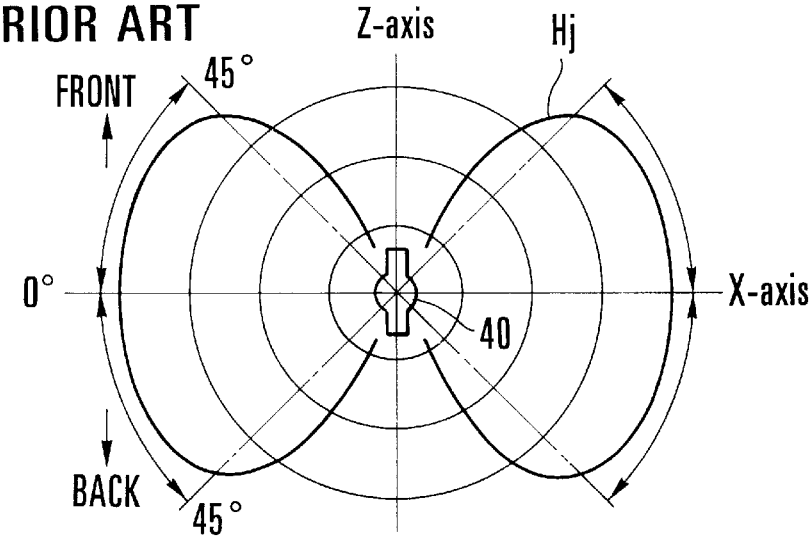
FIG. 5 PRIOR ART
FIG. 5 illustrates a light distribution pattern of the conventional automotive high pressure discharge lamp of FIG. 4.

FIG. 2 illustrates a light distribution pattern $H_k$ of an automobile headlight including the automotive high pressure discharge lamp 1. As compared to the light distribution pattern $H_j$ of the conventional automobile headlight 60 as shown in FIG. 5, the first preferred embodiment,of the present invention, an automotive high pressure discharge lamp 1 emits light forward and backward through a smaller angle range. In the conventional automotive high pressure discharge lamp 40, the light is emitted symmetrically, forward and backward, in an angle range of up to approximately 45°, centered on the X-axis.

Conversely, in the first preferred embodiment of the present invention, the light is emitted from the automotive high pressure discharge lamp 1 symmetrically, forward and backward, at an angle range of up to approximately 30°, centered on the X-axis, as shown in FIG. 1. The emitted light from an electrical arc A, formed between the electrodes 3, is refracted at the concave surface 11*a* and the convex surface 11*b* when the emitted light passes through the discharge chamber portion 11*c*.

Figure 6:
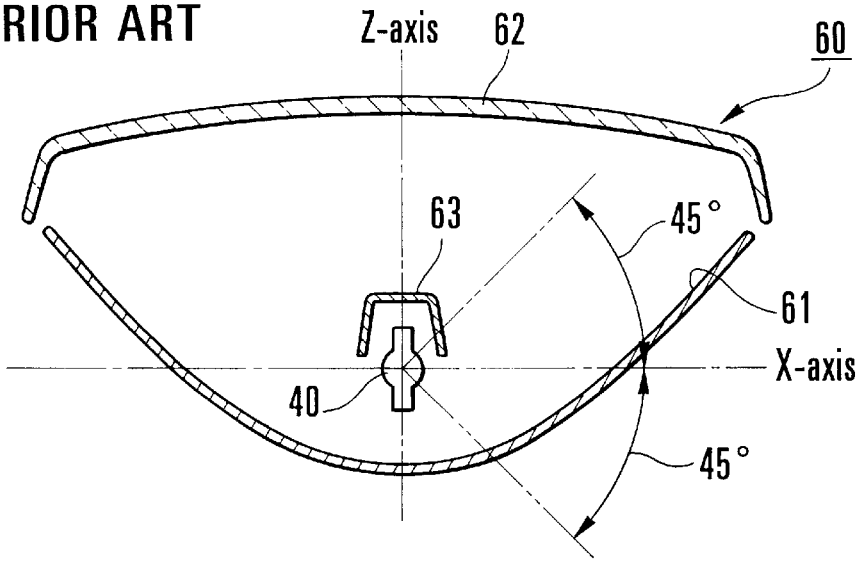
FIG. 6 PRIOR ART
FIG. 6 is a cross sectional view of a conventional automobile headlight including the conventional automotive high pressure discharge lamp of FIG. 4.

If the automotive high pressure discharge lamp 1 of FIG. 1 is used in the conventional automobile headlight 60, as shown in FIG. 6, with an angle range of up to approximately 30°, almost all light emitted from the electrical arc A is reflected by the reflector 61 without being prohibited by the shade 63. This configuration substantially improves the utilization efficiency of the emitted light from the electrical arc A, If electric power supplied to the automobile headlight 60 is 35 w, which is a standard value used in automobile head lamps, a diameter Φ1 of the concave surface 11*a*, of FIG. 1, is preferably approximately 2.7 mm. If the diameter Φ1 of the concave surface 11*a* is greater than approximately 2.7 mm, the electrical arc A is prone to curvature, and if the diameter Φ1 is less than approximately 2.7 mm, the utilization efficiency of the emitted light from the electrical arc A decreases. If the diameter Φ1 of the concave surface 11*a* is approximately 2.7 mm, the radius of curvature R1, centered on the X-axis that intersects the concave surface 11*a*, is approximately 18–19 mm. The reader should note that the radius of curvature lie along the X-axis. The X-axis is orthogonal to the Z-axis and passes through the electrical arc A at approximately a right angle.

Diameter Φ2 of the convex surface 11*b* lies within a range of approximately 5–7.5 mm and preferably lies within a range of 6–7 mm. The radius of curvature R2 of the convex surface 11*b* is approximately 4–6 mm and is centered on the X-axis that intersects the convex surface 11*b*. If the diameter Φ2 of the convex surface 11*b* is approximately 7.5 mm, the radius of curvature R2 is greater than approximately 4 mm. If the radius of curvature R2 is less than approximately 4 mm, it is difficult to make the bulb 2 thick enough to produce a good light distribution pattern.

If the diameter Φ2 of the convex surface 11*b* is less than approximately 5 mm, the radius of curvature R2 should be greater than approximately 6 mm to produce a good light distribution pattern, based on the thickness of the bulb 2. In this configuration, it is difficult to produce enough light flux for use as an automobile headlight, because the emitted light diffuses over a larger-than-expected area. If the diameter Φ2 of the convex surface 11*b* is greater than approximately 7.5 mm, it is also difficult to produce sufficient light flux for use as an automobile headlight. As a surface area of the bulb 2 increases, along with increasing heat loss, the total output of the automotive high pressure discharge lamp 1 decreases.

As the diameter Φ2 of the convex surface 11*b* increases, a color temperature of the emitted light increases. If the diameter Φ2 is approximately 6–7 mm, the color temperature is approximately 4100–4500° K. Conversely, when the diameter Φ2 is approximately 7.5 mm, the color temperature is approximately 5100° K. If the diameter Φ2 is approximately 8 mm, the color temperature substantially increases to approximately 6000° K. The color temperatures, when the diameter Φ2 is greater than approximately 7.5 mm, are much higher as compared to a standard color temperature value for use as an automobile headlight, and may blind drivers in the on-coming lane.

The automotive high pressure discharge lamp 1, the discharge chamber 11 and the discharge chamber portion 11*c* of the present invention are manufactured as follows. A silica glass pipe is heated, and softened at its center portion. The convex surface 11*b* is formed by rotating the pipe along a portion of its outer surface corresponding to the convex surface 11*b*. The outer surface contacts a pattern that has a predetermined curvature ratio and forms the convex surface 11*b*. Air is then introduced into the pipe at a first predetermined pressure, a second predetermined pressure is then applied to the glass pipe externally so as to cause the silica glass to retain the shape of the outer surface of the softened center portion.

The inner surface of the center portion deforms inwardly along the horizontal Z-axis of the automotive high pressure discharge lamp 1 to form the concave surface 11*a*. The sealed portions 13 and tapered portions 12*a* are formed simultaneously upon introduction of the electrodes 3, molybdenum foils 4, and lead wires 5 into the sealed ends 12. The silica glass pipe, at the portions corresponding to the sealed ends 12, is heated, melted, and molded with dies that together form a cavity having a predetermined shape to form the tapered portions 12*a* and the sealed portions 13.

The tapered portions 12*a* allow the bulb 2 to be free from substantial curvature change at the sealed portions 13. The tapering direction may be longitudinal, horizontal, or in both directions in a vertical cross-sectional view relative to the horizontal Z-axis of the automotive high pressure discharge lamp 1.

The advantages of the automotive high pressure discharge lamp according to the preferred embodiment of the present invention will now be described in detail. Since the light is emitted from the electrical arc A through a smaller angle range, the emitted light is substantially reflected by the reflector, allowing the use of virtually all of the light emitted from the electrical arc A for illumination. Accordingly, the automotive high pressure discharge lamp substantially improves its lumen output and power consumption efficiency. The composition further does not have a substantial curvature change that produces irregular light refraction, spot-shaped glare light, or stray light at the sealed portions.

Figure 3:
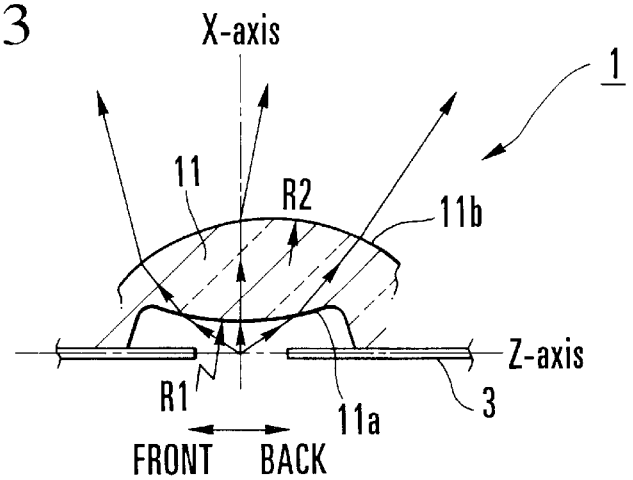
FIG. 3 is an enlarged view of a portion of a second preferred embodiment of the present invention.
Figure 4:
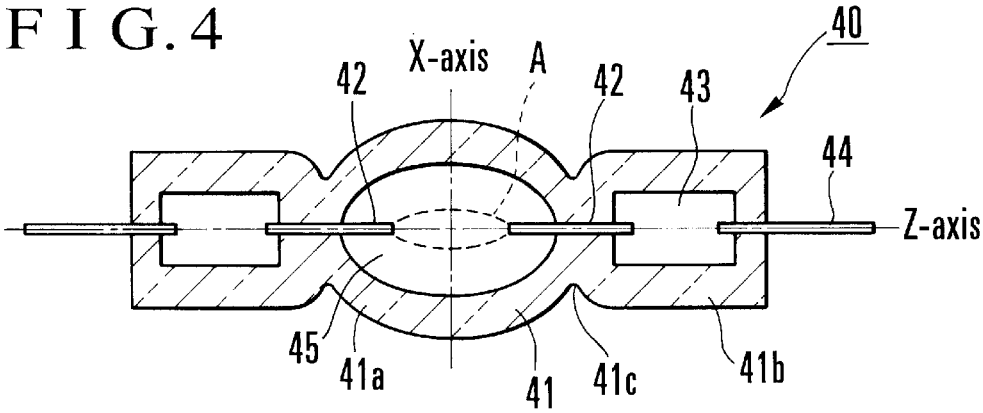
FIG. 4 is a cross-sectional view of a conventional automotive high pressure discharge lamp.

FIG. 3 illustrates schematically a center portion of the bulb of a second preferred embodiment of the present invention. In this configuration, the center of the radius R2 of the curvature of the convex surface 11*b* is behind the center of the radius R1 of the curvature of the concave surface 11*a*. Light is emitted from an electrical arc A (not shown) symmetrically, forward and backward. With respect to the X-axis, light is emitted through an angle range of 20° forward and 40° backward. This configuration greatly improves the utilization efficiency of the emitted light from the electrical arc A when a shallow reflector is used.

While the invention has been described in detail and with reference to specific embodiments thereof, it will be apparent to one skilled in the art that various changes and modifications can be made therein without departing from the spirit and scope thereof. Thus, it is intended that the present invention cover the modifications and variations of this invention provided they come within the scope of the appended claims and their equivalents.

What is claimed is:

1. A lamp bulb for a high pressure discharge lamp includes a pair of opposing electrodes that projects a predetermined distance into a discharge chamber, molybdenum foils, lead wires, and a bulb, the lamp bulb comprising:

a discharge chamber filled with a metal halide and a rare gas, the discharge chamber including at least a concave surface curving inwardly with respect to a Z-axis of the high pressure discharge lamp;

a discharge chamber portion surrounding the discharge chamber, including at least one convex surface curving outwardly with respect to the Z-axis of the high pressure discharge lamp;

a center portion of the concave surface and convex surface corresponding to an approximate center between both electrodes, and existing on a vertical line to the Z axis indicating a front back direction of the light source;

tapered portions tapering towards the discharge chamber;

sealed ends in which are located the molybdenum foils, the electrodes, and the lead wires; and sealed portions substantially free from substantial curvature change, the sealed portions being located between the discharge chamber and the sealed ends.

2. The lamp according to claim 1, wherein if electric power supplied to the high pressure discharge lamp is between 30–40 w, a diameter of the convex surface is within a range of approximately 5–7.5 mm.

3. The lamp according to claim 2, wherein a radius of curvature of the convex surface, which is centered along an X-axis, is 4–6 mm.

4. The lamp according to claim 3, wherein if the diameter of the convex surface is within a range of approximately 6–7 mm, a color temperature of emitted light is 4100–4500° K.

5. The lamp according to claim 4, wherein a tapering direction of the tapering portions is at least in one of a longitudinal direction or a horizontal direction when viewed along a vertical cross-section relative to the Z-axis of the high pressure discharge lamp.

6. The lamp according to claim 4, wherein a tapering direction of the tapering portion is in a longitudinal and a horizontal direction when viewed along a vertical cross-section relative to the Z-axis of the high pressure discharge lamp.

7. The lamp according to claim 2, wherein a diameter of the concave surface is approximately 2.7 mm.

8. The lamp according to claim 1, wherein a diameter of the concave surface is approximately 2.7 mm.

9. The lamp according to claim 8, wherein a radius of curvature of the concave surface, which is centered along an X-axis of the high pressure discharge lamp, is approximately 18–19 mm.

10. The lamp according to claim 9, wherein a tapering direction of the tapering portions is at least in one of a longitudinal direction or a horizontal direction when viewed along a vertical cross-section relative to the Z-axis of the high pressure discharge lamp.

11. The lamp according to claim 9, wherein a tapering direction of the tapering portions is in a longitudinal and a horizontal direction when viewed along a vertical cross-section relative to the Z-axis of the high-pressure discharge lamp.

12. The lamp according to claim 1, wherein a tapering direction of the tapering portions is at least in one of a longitudinal direction or a horizontal direction when viewed along a vertical cross-section relative to the Z-axis of the high pressure discharge lamp.

13. The lamp according to claim 1, wherein a tapering direction of the tapering portions is in a longitudinal and a horizontal direction when viewed along a vertical cross-section relative to the Z-axis of the high pressure discharge lamp.

14. The lamp according to claim 1, wherein light is emitted symmetrically at the same angle range centered on an X-axis of the lamp.

15. The lamp according to claim 1, wherein an angle range of emitted light in a forward direction is smaller than an angle range of emitted light in a backward direction centered along an X-axis of the lamp.

* * * * *